US008079319B2

(12) United States Patent
Kawaguchi et al.

(10) Patent No.: US 8,079,319 B2
(45) Date of Patent: Dec. 20, 2011

(54) SEWING MACHINE AND COMPUTER READABLE MEDIUM

(75) Inventors: Yasuhiko Kawaguchi, Nagoya (JP); Toshihiro Hanai, Kiyosu (JP); Masahiko Nagai, Nagoya (JP); Tomoyasu Niizeki, Inazawa (JP); Masashi Tokura, Nagoya (JP); Shinichi Nishida, Nagoya (JP); Noboru Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 884 days.

(21) Appl. No.: 12/153,429

(22) Filed: May 19, 2008

(65) Prior Publication Data

US 2008/0289552 A1 Nov. 27, 2008

(30) Foreign Application Priority Data

May 22, 2007 (JP) ..... 2007-134973

(51) Int. Cl.
*D05B 3/02* (2006.01)

(52) U.S. Cl. .... 112/445; 112/444; 112/453; 112/470.04

(58) Field of Classification Search ..... 112/444, 112/445, 447, 453, 470.01, 470.04; 700/136–138
See application file for complete search history.

(56) References Cited

U.S. PATENT DOCUMENTS

| | | | | |
|---|---|---|---|---|
| 4,860,675 | A * | 8/1989 | Brower et al. | 112/470.06 |
| 6,324,441 | B1 * | 11/2001 | Yamada | 700/138 |
| 7,908,027 | B2 * | 3/2011 | Noguchi et al. | 700/136 |

FOREIGN PATENT DOCUMENTS

| | | |
|---|---|---|
| JP | A-56-161083 | 12/1981 |
| JP | A-56-161087 | 12/1981 |
| JP | A-62-167587 | 7/1987 |
| JP | A-62-167588 | 7/1987 |
| JP | A-10-286384 | 10/1998 |
| JP | B2-3673834 | 5/2005 |

* cited by examiner

*Primary Examiner* — Nathan Durham
(74) *Attorney, Agent, or Firm* — Oliff & Berridge, PLC

(57) ABSTRACT

A sewing machine includes a sewing controller that controls sewing machine components, an imaging element capable of capturing facial images of a sewing machine user; a settings storage that stores settings for preset modes, the settings comprising items pertaining to sewing machine functions; a user information storage that stores facial image data of the user captured by the imaging element with mapping to the settings of the mode registered with the user; a verifier that verifies whether or not image data that matches the facial image data captured by the imaging element at sewing operation start exists in the user information storage; and an instruction controller that reads the settings from the user information storage when receiving a positive verification result from the verifier, and that instructs the sewing controller to control the sewing machine components based on the settings read.

7 Claims, 16 Drawing Sheets

19a

| ITEM NO. | MODE | BEGINNER | INTERMEDIATE | EXPERT |
|---|---|---|---|---|
| 1 | SEWING SPEED | 600rpm | 800rpm | 1000rpm |
| 2 | NUMBER OF PATTERNS DISPLAYED | 30 | 50 | 100 |
| 3 | SIZE OF CHARACTERS DISPLAYED | LARGE | NORMAL | SMALL |
| 4 | TERMINOLOGY | EASY | PLAIN | SPECIAL |
| 5 | SPEED AT SEWING START | SLOW | NORMAL | FAST |
| 6 | ERROR SOUND | ALL | WARNING ONLY | NONE |
| ⋮ | ⋮ | ⋮ | ⋮ | ⋮ |
| 20 | BRIGHTNESS | BRIGHT | NORMAL | DARK |

SETTINGS

FIG.3

| | | | |
|---|---|---|---|
| | | RECOGNITION IMAGE DATA OF USER (MOTHER) |  |
| | | MODE | INTERMEDIATE |
| ITEM NO. | 1 | SEWING SPEED | 800rpm |
| | 2 | NUMBER OF PATTERNS DISPLAYED | 50 |
| | 3 | SIZE OF CHARACTERS DISPLAYED | NORMAL |
| | 4 | TERMINOLOGY | PLAIN |
| | 5 | SPEED AT SEWING START | NORMAL |
| | 6 | ERROR SOUND | WARNING ONLY |
| | ⋮ | ⋮ | ⋮ |
| | 20 | BRIGHTNESS | NORMAL |

SETTINGS

19c

| | | GESTURE EXPRESSION RECOGNITION IMAGE DATA | OPERATION INSTRUCTIONS |
|---|---|---|---|
| ITEM NO. | 1 | OPEN MOUTH | STOP SEWING |
| | 2 | WINK | START SEWING |
| | 3 | STICK OUT TONGUE | FORM REVERSE STITCH |
| | 4 | MOVE FACE CLOSER | DECELERATE SEWING SPEED |
| | 5 | MOVE FACE FARTHER AWAY | ACCELERATE SEWING SPEED |
| | 6 | LEAN HEAD | SWITCH NEEDLE VERTICAL POSITIONING |
| | 7 | SHAKE HEAD | SWITCH PRESSER FOOT VERTICAL POSITIONING |
| | ⋮ | ⋮ | ⋮ |
| | 10 | LOOK DOWN | CUT THREAD |

FIG. 5

| | | | |
|---|---|---|---|
| | | RECOGNITION IMAGE DATA OF USER (DAUGHTER) |  |
| | | MODE | BEGINNER |
| ITEM NO. | 1 | SEWING SPEED | 600rpm |
| | 2 | NUMBER OF PATTERNS DISPLAYED | 30 |
| | 3 | SIZE OF CHARACTERS DISPLAYED | LARGE |
| | 4 | TERMINOLOGY | EASY |
| | 5 | SPEED AT SEWING START | SLOW |
| | 6 | ERROR SOUND | ALL |
| | ⋮ | ⋮ | ⋮ |
| | 20 | BRIGHTNESS | BRIGHT |

SETTINGS

19b

GM

| | | | |
|---|---|---|---|
| | | RECOGNITION IMAGE DATA OF USER (GRANDMOTHER) |  |
| | | MODE | EXPERT |
| ITEM NO. | 1 | SEWING SPEED | 1000rpm |
| | 2 | NUMBER OF PATTERNS DISPLAYED | 100 |
| | 3 | SIZE OF CHARACTERS DISPLAYED | SMALL |
| | 4 | TERMINOLOGY | SPECIAL |
| | 5 | SPEED AT SEWING START | FAST |
| | 6 | ERROR SOUND | NONE |
| | ⋮ | ⋮ | ⋮ |
| | 20 | BRIGHTNESS | DARK |

SETTINGS

19b

YM

| | | | |
|---|---|---|---|
| | | RECOGNITION IMAGE DATA OF USER (MOTHER) |  |
| | | MODE | INTERMEDIATE |
| ITEM NO. | 1 | SEWING SPEED | 800rpm |
| | 2 | NUMBER OF PATTERNS DISPLAYED | 100 |
| | 3 | SIZE OF CHARACTERS DISPLAYED | NORMAL |
| | 4 | TERMINOLOGY | PLAIN |
| | 5 | SPEED AT SEWING START | NORMAL |
| | 6 | ERROR SOUND | WARNING ONLY |
| | ⋮ | ⋮ | ⋮ |
| | 20 | BRIGHTNESS | NORMAL |

SETTINGS

19b

GM

| | | | |
|---|---|---|---|
| | | RECOGNITION IMAGE DATA OF USER (GRANDMOTHER) |  |
| | | MODE | EXPERT |
| ITEM NO. | 1 | SEWING SPEED | 1000rpm |
| | 2 | NUMBER OF PATTERNS DISPLAYED | 100 |
| | 3 | SIZE OF CHARACTERS DISPLAYED | LARGE |
| | 4 | TERMINOLOGY | SPECIAL |
| | 5 | SPEED AT SEWING START | FAST |
| | 6 | ERROR SOUND | NONE |
| | ⋮ | ⋮ | ⋮ |
| | 20 | BRIGHTNESS | BRIGHT |

SETTINGS

SEWING MACHINE AND COMPUTER READABLE MEDIUM

CROSS-REFERENCE TO RELATED APPLICATIONS

This application is based upon and claims the benefit of priority from the prior Japanese Patent Application 2007-134973, filed on May 22, 2007, the entire contents of which are incorporated herein by reference.

FIELD

The present disclosure relates to the art of sewing machine control, and more specifically to controlling components of a sewing machine based on settings preset in either of user modes classified by user technical maturity.

BACKGROUND

An electronic zigzag sewing machine such as a lock-stitch sewing machine conventionally offers standard equipment of functions such as needle swinging, sewing speed control, slow start, and display settings; where the needle swinging function swings a sewing needle by swinging a needle bar, the sewing speed control function allows change in sewing speed, the slow start function decelerates the sewing speed at sewing start, and the display settings allows modification of settings such as size of characters displayed in messages, and the like, on a liquid crystal display.

For instance, the pattern sewing machine described in JP H10-286384 A (pages 5 to 7, FIGS. 7 and 8), keeps track of count of user operation of each function key provided for selection of a sewing pattern in the pattern selection process. The count of user operation is represented by operation count I which is incremented every time the corresponding function key is operated. Technical maturity of the user is evaluated based on the count of operation count I of the function keys, and a maturity level classified into levels of "1 to 3" is assigned to the user based on the evaluation. Depending on the maturity level assigned to the user, either one of icons "M1 to M3" and a predetermined number of sewable patterns both preset to each sewing level "1 to 3" are both displayed to the user. Similarly, in an edit process control, a maturity level of "1 to 3" is determined based on the operation count I of the function key, and either one of the icons "M1 to M3" and a predetermined number of sewable patterns both preset to each editing level "1 to 3" are both displayed to the user.

In the pattern sewing machine described in the above publication, user technical maturity is detected (determined) based on the accumulated operation count I of the function keys after the date of purchase of the sewing machine. Hence, if the sewing machine is purchased by a young girl who is inexperienced in operating a sewing machine and the sewing machine is being shared by her family, in this case, her mother and her grandmother, the operation count I will not show much increase after the date of purchase while the sewing machine is mainly used by the young girl. Under such state, when her mother and grandmother, being experienced in sewing machine operation, use the sewing machine, they are only allowed to sew small number of sewing patterns and use only simple function keys, being unreasonably constrained by the limitations applied to the young girl who is an inexperienced user.

Contrastingly, after substantial lapse of time after the date of purchase of the sewing machine where operation count I of the function keys have substantially increased and maturity level has grown substantially high, and the young girl's younger sister, for example, who is even more inexperienced in sewing machine operation, uses the sewing machine under such state, she may hesitate to use the sewing machine or feel uncomfortable in operating the sewing machine since she is forced to select a pattern requiring high sewing skills from the very beginning and may encounter display of function keys for use by experienced users which is not for use by beginners.

SUMMARY

The purpose of the present disclosure is to extensively improve usability of the sewing machine by allowing control of the sewing machine components under settings that are suitable to the technical skills of each user of the sewing machine even when a single sewing machine is shared by multiple users of various technical skills (maturity).

The present disclosure discloses a sewing machine including a sewing controller that controls a plurality of sewing machine components; an imaging element capable of capturing facial images of a sewing machine user; a settings storage that stores settings for a plurality of preset modes, the settings comprising a plurality of items pertaining to a plurality of sewing machine functions; a user information storage that stores facial image data of the user captured by the imaging element with mapping to the settings of the mode registered with the user; a verifier that verifies whether or not image data that matches the facial image data captured by the imaging element at sewing operation start exists in the user information storage; and an instruction controller that reads the settings from the user information storage when receiving a positive verification result from the verifier, and that instructs the sewing controller to control the sewing machine components based on the settings read.

The above described sewing machine provided with the sewing controller for controlling the sewing machine components includes the imaging element, the settings storage, the user information storage, the verifier, and the instruction controller. Thus, by merely storing the facial image data of the user with mapping to the settings of the registered mode in user information storage prior to execution of sewing operation, the sewing machine components can be controlled based on the preset user settings. This arrangement improves the usability of the sewing machine since the sewing machine is controlled according to user technical maturity.

The present disclosure also discloses a computer readable medium storing a control program for use in a sewing machine including a sewing controller that controls a plurality of sewing machine components, an imaging element capable of capturing facial images of a sewing machine user, and data storage that stores settings for a plurality of preset modes, the settings comprising a plurality of items pertaining to a plurality of sewing machine functions, the control program including an instruction for storing facial image data of the user captured by the imaging element in the data storage with mapping to the settings of the mode registered with the user; an instruction for verifying whether or not image data that matches the facial image data captured by the imaging element at sewing operation start exists in the data storage; and an instruction for instructing the sewing controller to control the sewing machine components based on the settings read from the data storage when receiving a positive verification result.

The control program stored in the medium is read and executed by a computer.

BRIEF DESCRIPTION OF THE DRAWINGS

Other objects, features and advantages of the present disclosure will become clear upon reviewing the following description of the illustrative aspects with reference to the accompanying drawings, in which.

FIG. 3 describes a data configuration of a settings memory;

FIG. 5 describes a data configuration of a gesture expression memory;

DETAILED DESCRIPTION

One exemplary embodiment of the present disclosure will be described with reference to the drawings.

Figure 1:
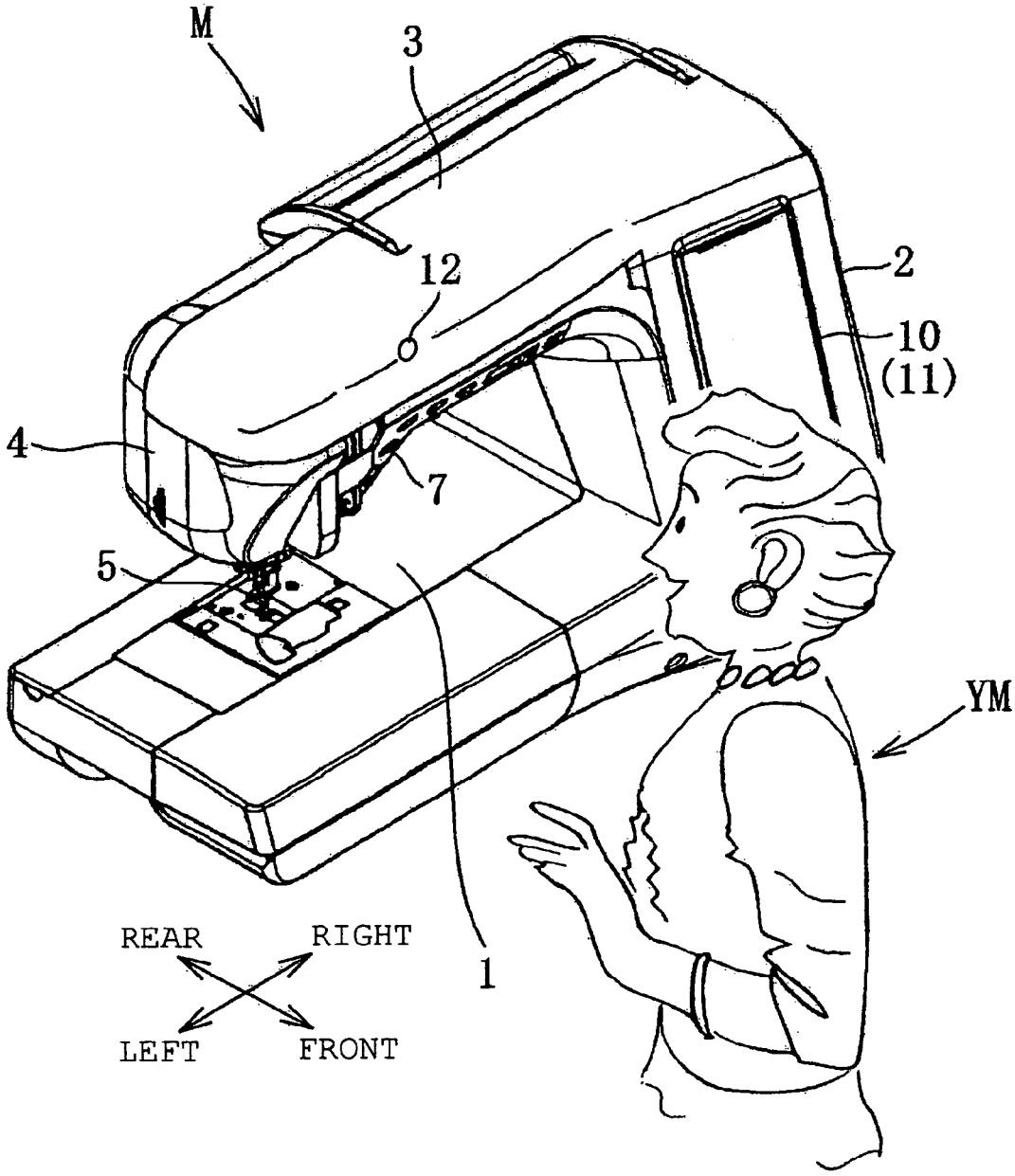
FIG. 1 is a perspective view of an electronic zigzag sewing machine according to one illustrative aspect of the present disclosure.

A brief description will be given on the electronic zigzag sewing machine (hereinafter simply referred to as a sewing machine). Referring to FIG. 1, sewing machine M, being configured like a general household electronic sewing machine, includes: a bed 1, a pillar 2 standing on the right end of bed 1, an arm 3 extending over bed 1 from the upper end of pillar 2, and a head 4 provided on the left end of arm 3.

Arm 3 includes components such as a sewing machine main shaft (not shown) rotated by a sewing machine motor 24 (refer to FIG. 2), a hand pulley (not shown) allowing manual rotation of the sewing machine main shaft, a needle bar drive mechanism (not shown) that vertically moves a needle bar (not shown) having a sewing needle 5 attached on its lower end, and a needle swing mechanism (not shown) driven by a needle bar swing motor 25 (refer to FIG. 2) that swings the needle bar in the lateral direction perpendicular to the cloth feed direction, a thread take-up drive mechanism (not shown) that vertically moves the thread take-up (not shown) in synchronization with the vertical movement of the needle bar, a presser-bar vertically moving mechanism (not shown) driven by a presser-bar vertically moving motor 26 (not shown) and that vertically moves the presser bar (not shown) between a lifted position and a lowered position.

Figure 2:
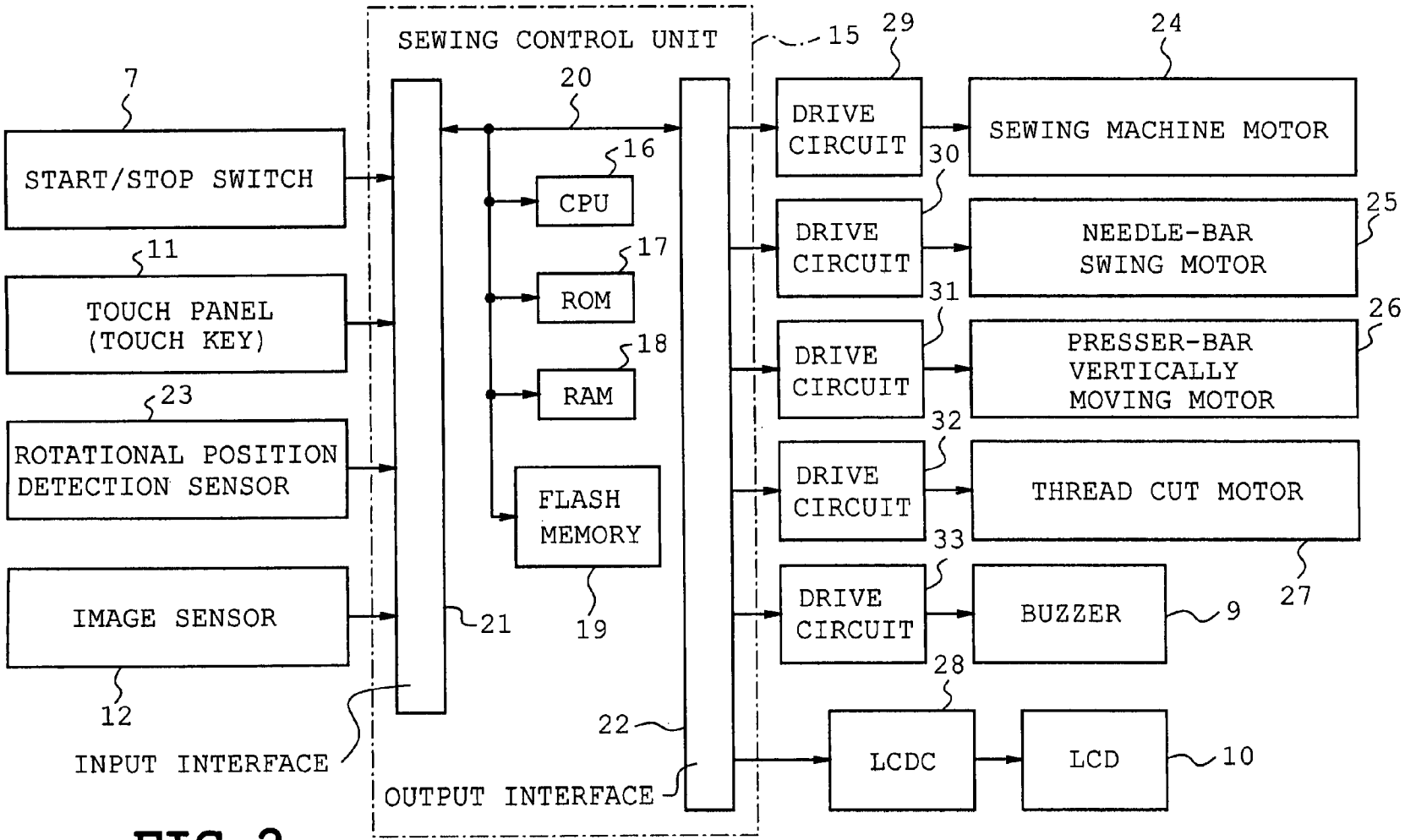
FIG. 2 is a block diagram of a control system of the electronic zigzag sewing machine.

Provided on the front face of arm 3, are various types of switches such as a sewing start/stop switch 7 for instructing start/stop of the sewing machine and other components such as a buzzer 9 (refer to FIG. 2). Buzzer 9 informs error detection such as unintentional operation of start/stop switch 7 when a presser foot attached to the lower end of the presser bar is in the lifted position, and detection of abnormalities such as occurrence of thread cut during a sewing operation.

Bed 1 includes a cloth feed mechanism (not shown) that moves a feed dog (not shown) vertically and longitudinally, a rotary hook (not shown) that contains a bobbin thread bobbin (not shown) and that is driven by a lower shaft (not shown) driven conjunctively with the main shaft, and a thread cut mechanism (not shown) driven by a thread cut motor 27 (refer to FIG. 2) to effect motion of a movable blade (not shown) for cutting the needle thread and the bobbin thread in cooperation with a stationary blade (not shown).

On the front face of pillar 2, an elongate color liquid crystal display (hereinafter referred to as LCD) 10 is provided for displaying images of different types of patterns such as utility patterns, decorative patterns, and character patterns as well as various function names, pattern names and messages. Further, images captured by a later described image sensor 12 are displayed as required. On the front face of LCD 10, a touch panel 11 (refer to FIG. 2) comprising transparent electrodes are provided for allowing selection of patterns to be sewn and functions to be executed. The selection and execution are made by user operation of touch keys (not shown) provided on touch panel 11, though not described in detail at this point.

Referring again to FIG. 1, on the upper front face of arm 3, a compact image sensor 12 is provided so as to capture the image of an object existing in front of the sewing machine. Image sensor 12 comprises a CCD (Charge Coupled Device) imaging element. As shown in FIG. 1, when the user, mother YM in the present exemplary embodiment, appears in front of and in close proximity of sewing machine M to perform a sewing operation, the front face of mother YM can be fully captured by image sensor 12.

Next, a description will be given on a control system of electronic zigzag sewing machine M.

Referring to FIG. 2, a sewing controller 15 is configured by a computer comprising a CPU 16, a ROM 17, a RAM 18, and a flash memory 19 (programmable nonvolatile memory), an input interface 21 and an output interface 22, which are mutually connected by a common bus 20 such as data bus.

Input interface 21 establishes electrical connection with components such as start/stop switch 7, touch panel 11 provided with touch keys, a rotational position detection sensor 23 that detects rotational position of the sewing machine main shaft, and image sensor 12. Output interface 22 establishes electrical connections with components such as drive circuits 29, 30, 31, 32, 33, that drive sewing machine motor 24, needle-bar swing motor 25, presser-bar vertically moving motor 26, thread cut motor 27, and a buzzer 9, and a liquid crystal display controller (LCDC) 28 that drives color LCD 10.

ROM 17 pre-stores control programs such as control programs that drive each types of motors 24 to 27, and control programs for later described user registration and operation execution. RAM 18 allocates sewing data memory for storing sewing data of sewing patterns, a display buffer for storing display data to be displayed on LCD 10, and other types of memory and buffer as required.

Figure 4:
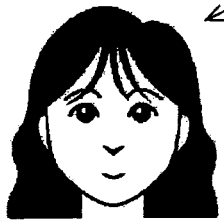
FIG. 4 describes a data configuration of data for user "mother YM" stored in a user information memory.

Flash memory 19 includes a settings memory 19*a* shown in FIG. 3, a user information memory 19*b* shown in FIG. 4, and a gesture expression memory 19*c* shown in FIG. 5. Thus, even if power of sewing machine M is shutdown, any given data stored in memory 19*a* to 19*c* will remain intact. The content of settings in user information memory 19*b* is editable.

Settings memory 19*a*, as shown in FIG. 3, pre-stores settings for three modes, namely, "beginner", "intermediate", and "expert" classified by user technical maturity. Each of the three settings has different settings for "item no. 1" to "item no. 20" pertaining to a plurality of functions of sewing machine M as can be seen in FIG. 3. Settings of each item for each of the three modes are editable.

In the present exemplary embodiment, "item no. 1" denotes "sewing speed" during sewing operation; "item no. 2", a sewable "number of patterns displayed" on LCD 10; "item no. 3", "size of characters displayed" on LCD 10; "item no. 4", "terminology" used in describing the usage of each function and mechanism; "item no. 5", "sewing start speed" at sewing start; "item no. 6", "error sounds" produced at occurrence of various errors such as misuse of sewing machine M; . . . and "item no. 20", "brightness" of LCD 10.

For instance, in case "mother YM" is registered with mode "intermediate", the user information memory 19*b* stores recognition image data of the user "mother YM" with mapping to mode "intermediate", and settings pertaining to "intermediate" read from settings memory 19*a*.

Figure 14:
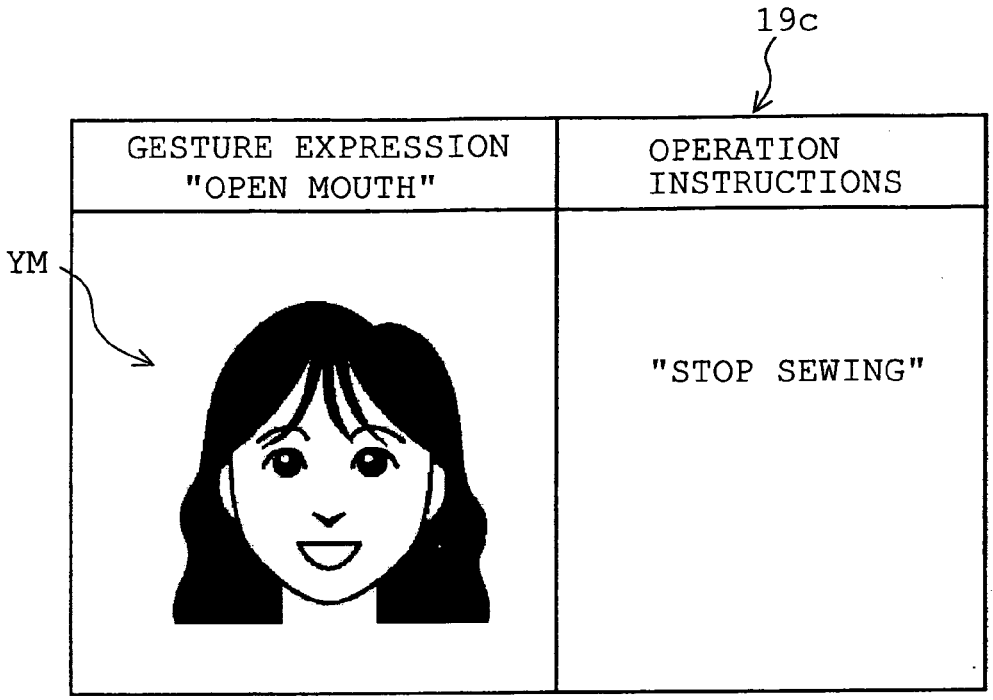
FIG. 14 is a portion of FIG. 5 describing a data configuration of "mother YM" for gesture expression "open your mouth"

Gesture expression memory 19*c* shown in FIG. 5 stores captured recognition image data of a plurality of different facial gesture expressions of the user with mapping to the corresponding operation instructions. For instance, as can be seen in FIG. 14, for user "mother YM", the recognition image data of "open mouth" gesture expression with mapping to operation instruction "stop sewing" is stored in gesture expression memory 19*c*.

Figure 6:
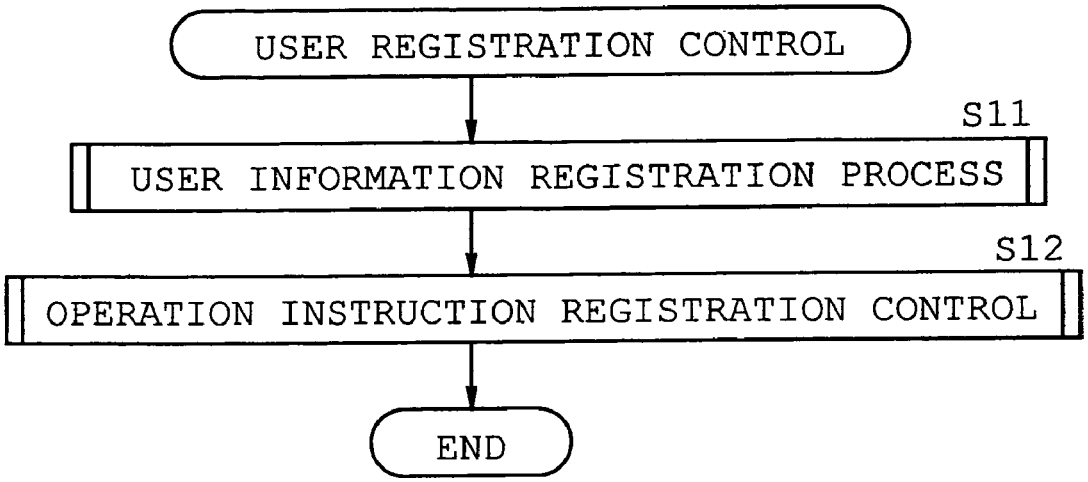
FIG. 6 is a flowchart of a user registration control.
Figure 7:
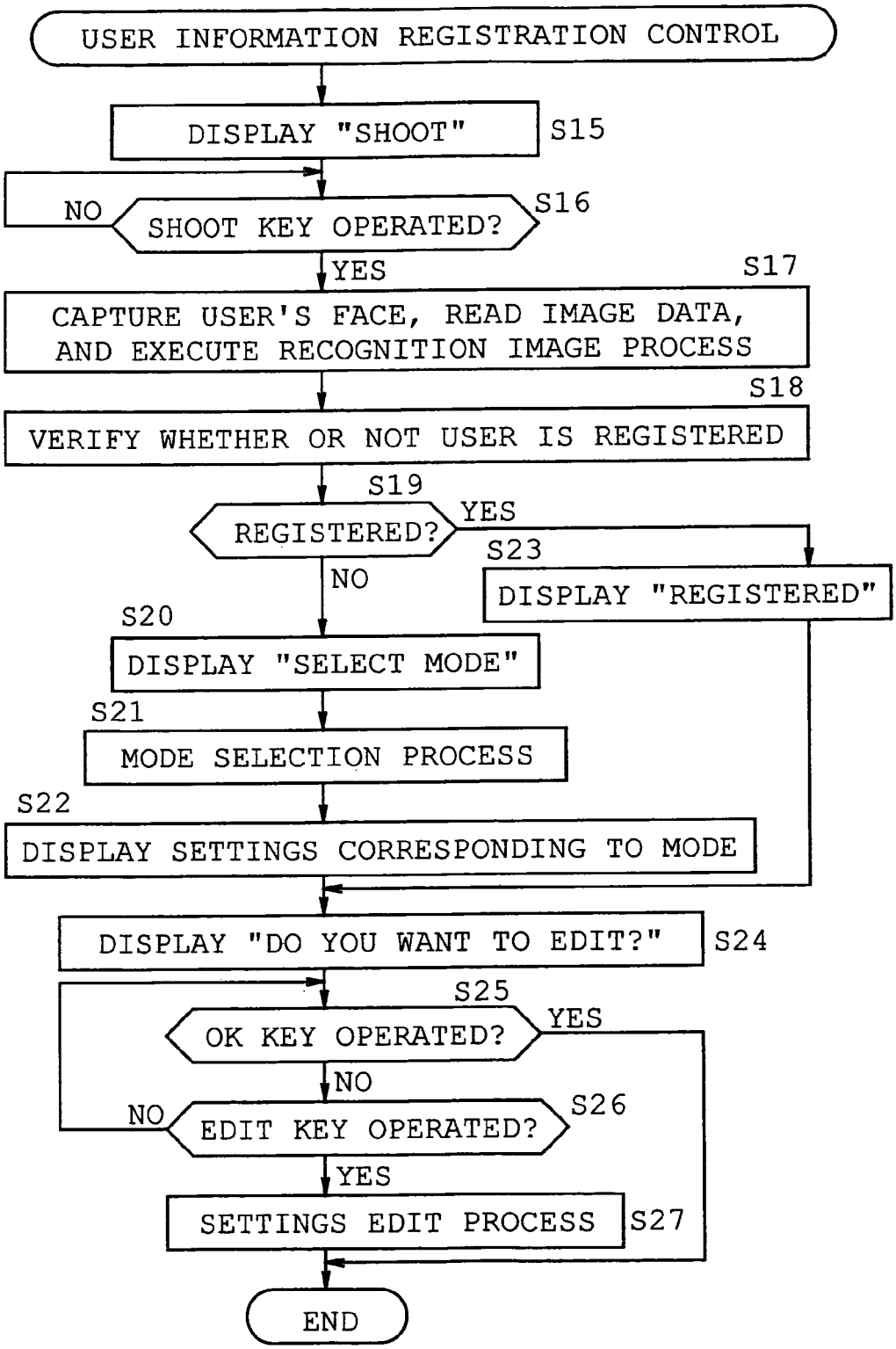
FIG. 7 is a flowchart of a user information registration control.
Figure 8:
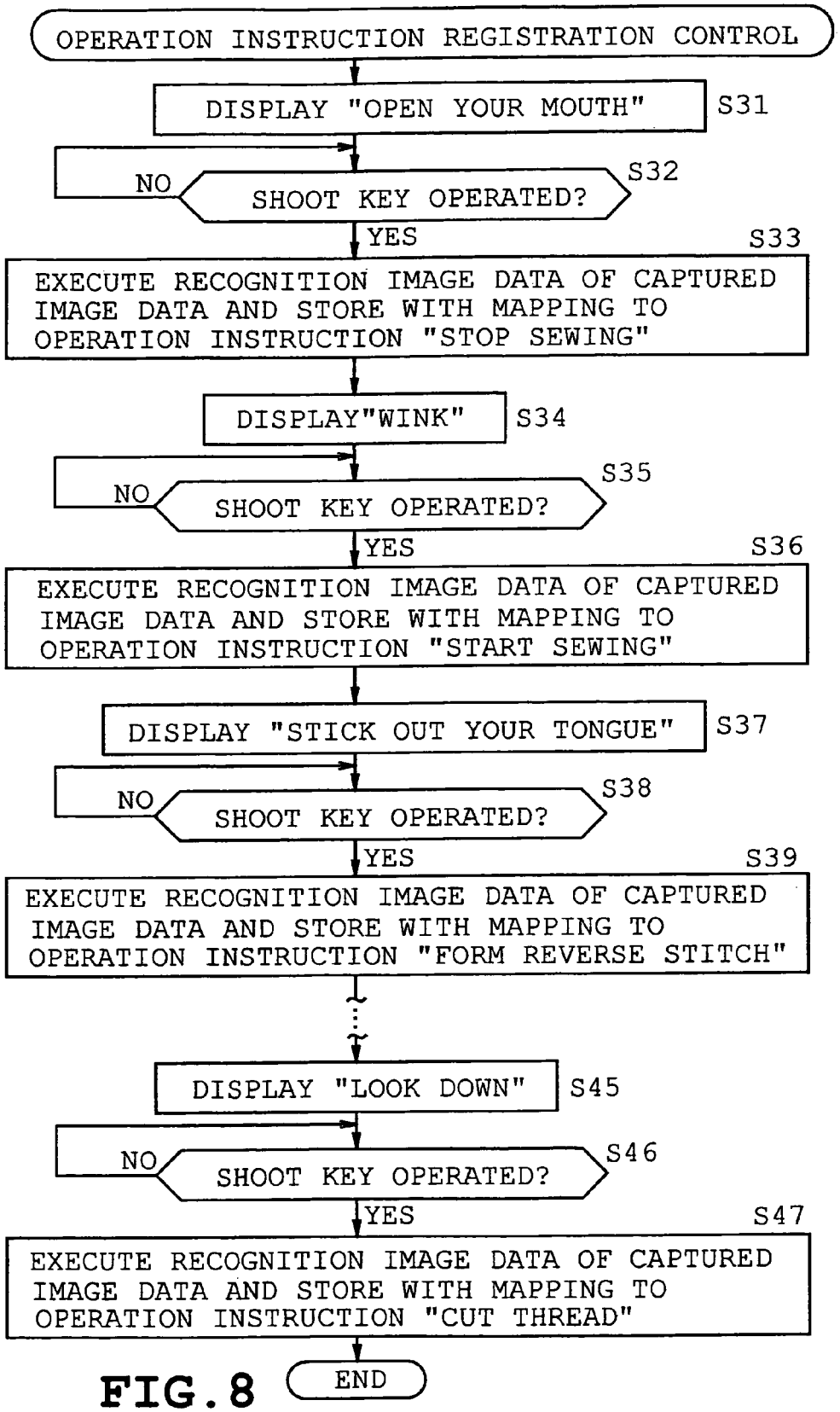
FIG. 8 is a flowchart of an operation instruction registration control.

Next, user registration control executed at sewing controller 15 will be described based on the flowcharts indicated in FIGS. 6 to 8. Symbols Si (i=11, 12, 13 . . . ) indicate each step of the process flow.

This control is executed when "user registration key" represented as a touch key on LCD 10 is depressed by the user after power is turned on. When the control is started, first, user information registration control (refer to FIG. 7) is executed for registration of user information (S11). In this control, first, the user is required to settle into a posture allowing his/her front face to be captured by image sensor 12. At this instance, a message is displayed on LCD 10 that reads "shoot" (S15), in response to which the user, facing image sensor 12, operates a "shoot key" of touch panel 11 (S16: Yes). The front face of the user is thus, captured for subsequent execution of image recognition (S17).

In the recognition image process, the image data provided by image sensor 12 is utilized to generate recognition image data for enabling recognition of the front face of the user. The recognition image process is performed according to the following steps as known in the art. First, the "front face" image data of the user is binarized by a "threshold" that distinguishes "facial information" from "non-facial information" pertaining to portions such as the background of the image data. Then, noise cancellation, and the like processes are performed. Finally, an outline extraction process is executed to produce the "front face" for user recognition.

Next, a verification process is executed for verifying whether or not recognition image data identical to or nearly identical to the recognition image data of the "front face" obtained at S17 exists in user settings memory 19*b* (S18). As the result of verification, if no registration is found (S19: No), a message is displayed on LCD 10 that reads "select mode" (S20). Then, the user selects the intended mode from the plurality of modes, namely, "beginner", "intermediate", and "expert" displayed on LCD 10 (S21).

At this time, settings corresponding to the selected mode are displayed on LCD 10 in tabular format (S22) to allow visual confirmation by the user. Then, a message is displayed on LCD 10 that reads "Do you want to edit?" (S24). If the user wishes to edit the settings, an edit key (S26: Yes) may be pressed to allow editing of settings for each item displayed on LCD 10 (S27), at which point the control is terminated and the control flow returns to S12 of the user registration control (refer to FIG. 6).

If no editing is required, the control is terminated immediately upon depression of OK key (S25: Yes). If a registration is found under the user as the result of verification (S19: Yes), a message is displayed on LCD 10 that reads "registered" (S23). At this instance also, a message is displayed on LCD 10 that reads "Do you want to edit?" (S24). If editing is required, the user may press the edit key (S26: Yes) to edit the settings (S27). If editing is not required, the OK key is pressed (S25: Yes) to terminate the control and return the control flow to S12.

Next, the user registration control executes an operation instruction registration process (refer to FIG. 8) (S12). In this control, first, a message is displayed on LCD 10 that reads "open your mouth" (S31), whereupon the user responsively faces image sensor 12 and presses the shoot key (S32: Yes) with his/her mouth opened. Thus, gesture expression of the user, in this case, the opened mouth expression is captured as the image data, which is processed into recognition image data by the recognition image process. Then, the recognition image data is mapped with the instruction "stop sewing", and stored in gesture expression memory 19*c* (S33).

Next, a message is displayed on LCD 10 that reads "wink" (S34), whereupon the user responsively faces image sensor 12 with a wink and presses the shoot key (S35: Yes). Thus, the gesture expression of the user, in this case, the wink, is captured as the image data, which is processed into recognition image data by the recognition image process. Then, the recognition image data is mapped with the instruction "start sewing", and stored in gesture expression memory 19*c* (S36).

Next, a message is displayed on LCD 10 that reads "stick out your tongue" (S37), whereupon the user responsively faces image sensor 12 with his/her tongue sticking out and presses the shoot key (S38: Yes). Thus, the gesture expression of the user, in this case, the stuck out tongue, is captured as the image data, which is processed into recognition image data by the recognition image process. Then, the recognition image data is mapped with the instruction "form reverse stitch", and stored in gesture expression memory 19*c* (S39).

Likewise, messages corresponding to the remaining gesture expressions illustrated in FIG. 5, such as "move your face closer", "move your face farther away", "lean your head to the left or right", and "shake your head to the left or right" are displayed sequentially on LCD 10, and each gesture expression of the user is captured by depressing the shoot key. Then the generated recognition image data are each mapped with the corresponding operation instruction, namely, "decelerate sewing speed", "accelerate sewing speed", "switch vertical positioning of the needle", and "switch vertical positioning of the presser foot" and stored in gesture expression memory 19*c*.

Finally, a message is displayed on LCD 10 that reads "look down" (S45), whereupon the user responsively faces image sensor 12, looks down, and presses the shoot key (S46: Yes). Thus, the gesture expression of the user, in this case, the user looking down, is captured as the image data, which is processed into recognition image data by the recognition image process. Then, the recognition image data is mapped with the instruction "cut thread", and stored in gesture expression memory 19*c* (S47) to terminate this control and the user registration control as well.

Figure 9A:
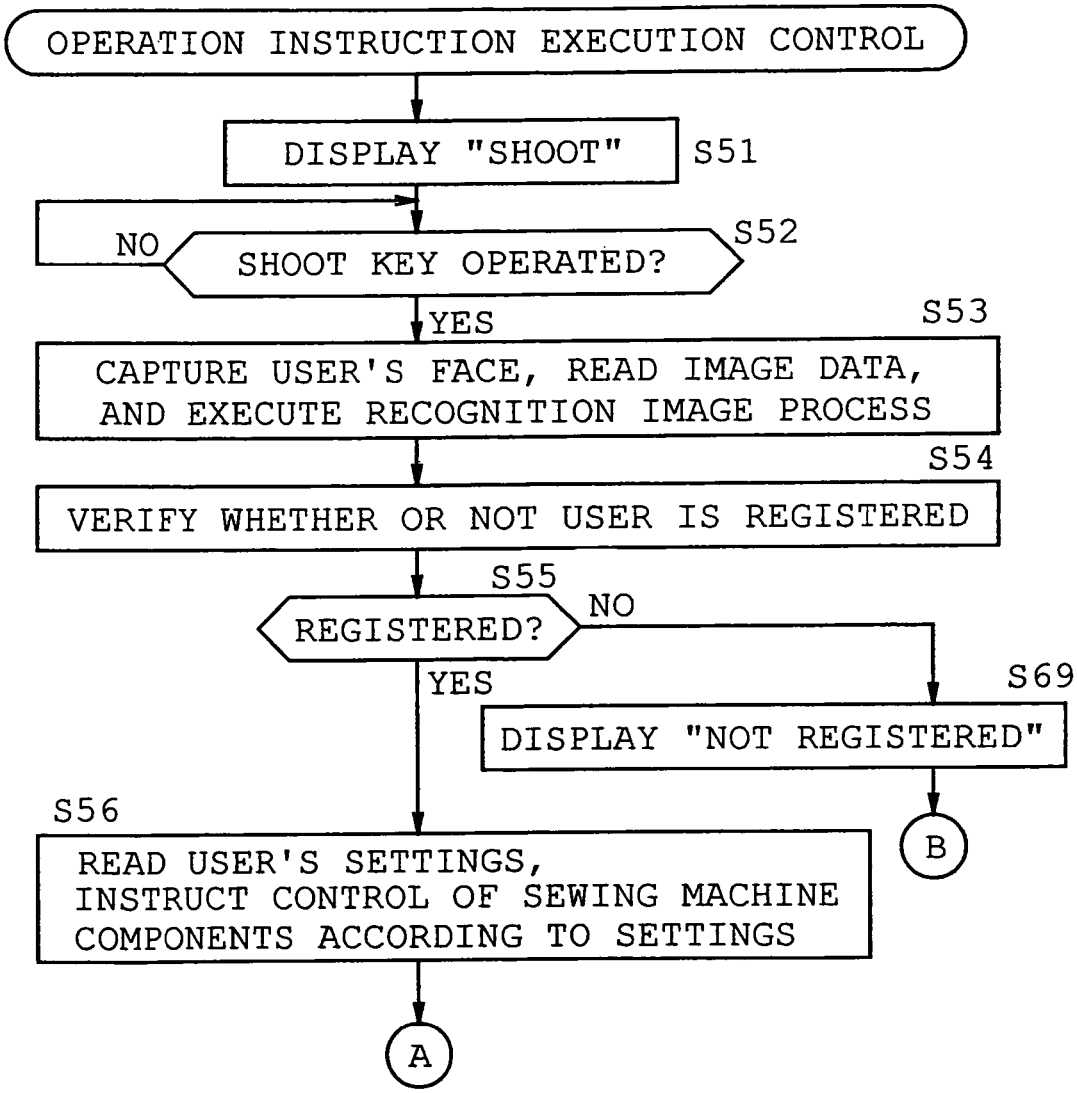
FIG. 9 is a flowchart of an operation instruction execution control.
Figure 9B:
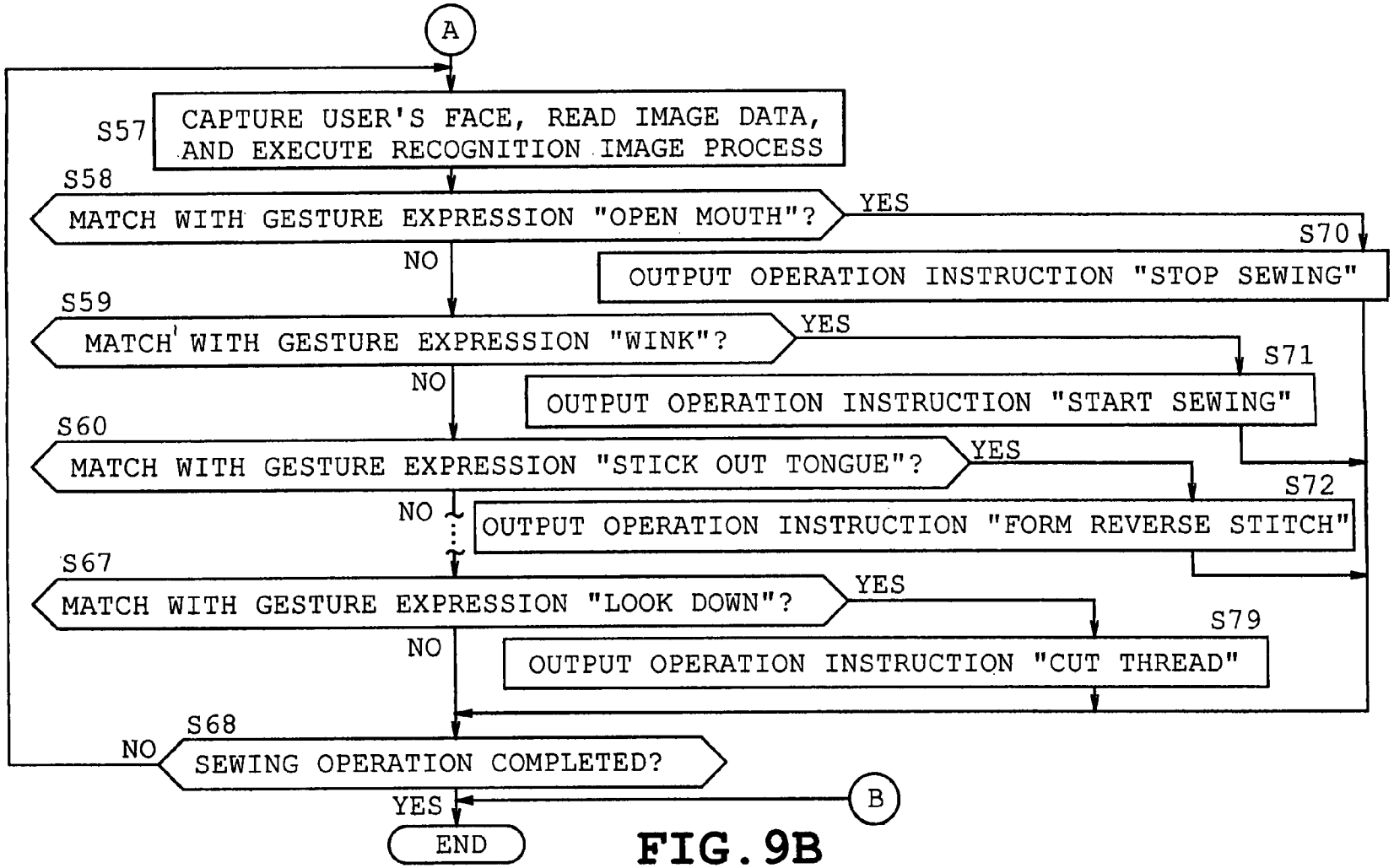

Next, when the user presses the touch key "operation instruction execution key" to start the sewing process, an operation instruction execution control indicated in FIG. 9 is executed. As the first step of this control, a message that reads "shoot" is displayed on LCD 10 (S51). Then, when the user faces image sensor 12 and presses the shoot key (S52: Yes), recognition image data that allows user recognition is generated based on the image data obtained by capturing the front face of the user as in S17 (S53).

Then, the verification process is executed to verify whether or not recognition image data identical to or nearly identical to the recognition image data of the "front face" obtained at S53 exists in user settings memory 19*b* (S54). As the result of verification, if the registration of the user is found, in other words, if the result of verification is positive (S55: Yes), all the pre-registered settings corresponding to the user are read from user settings memory 19*b* and the sewing machine components are controlled in accordance with the information specified in the plurality items of the settings (S56). At this instance, since the settings preset for the plurality of items of each mode registered with each user are applied on the sewing machine components, sewing operation can be started immediately.

Next, the front face of the user is captured again by image sensor 12 and the recognition image data is generated by the recognition image process (S57). Then, gesture expression memory 19*c* is sequentially searched based on the recognition image data to verify whether or not the gesture expression of the user's face matches "open your mouth" of "item no. 1", "wink" of "item no. 2", "stick out your tongue" of "item no. 3" . . . , and finally, "look down" of "item no. 10".

If the gesture expression of the user's face captured by image sensor 12 does not match any of the pre-registered gesture expressions (S58: No, S59: No, S60: No, . . . , and S67: No), S57 to S68 are repeated if sewing operation is not completed (S68: No). If the recognition image data is found to match "open your mouth" of "item no. 1" (S58: Yes) as the result of series of search, the operation instruction of "stop sewing" is outputted (S70).

If the recognition image data is found to match the gesture expression "wink" of "item no. 2" (S59: Yes), the operation instruction of "start sewing" is outputted (S71). Similarly, if a match with the gesture expression "stick out your tongue" of "item no. 3" is found as the result of search (S60: Yes), the operation instruction of "form reverse stitch" is outputted (S72). Thereafter, though not shown, if a match with either of the gesture expressions of "item no. 4" to "item no. 9" indicated in FIG. 5 is found, the corresponding operation instructions are outputted respectively. Then, as the result of search, when a match with gesture expression "look down" of "item no. 10" is found (S67: Yes), the operation instruction of "cut thread" is outputted (S79).

The operation instruction execution control is terminated upon completion of the sewing operation (S68: Yes). If the recognition image data of the user captured by image sensor 12 is not registered in user information memory 19*b* as the result of the verification process at S54, in other words, if the result of verification is negative (S55: No), a message is displayed on LCD 10 that reads "not registered" (S69) and the control is terminated immediately.

Next, a description will be given on the operation and effect of the electronic zigzag sewing machine M.

The description will be given for each user, starting from the case where the user is "mother YM". Mother YM, being relatively skillful in sewing machine operation, will register herself with mode "intermediate" after capturing her front face with image sensor 12 without any gesture expressions. Thus, the recognition image data of the front face of user "mother YM" is stored in user settings memory 19*b* with mapping to mode "intermediate", and settings for mode "intermediate" read from settings memory 19*a* as shown in FIG. 4.

Figure 12:
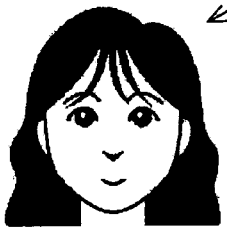
FIG. 12 corresponds to FIG. 4 after user editing of settings.

Mother YM being relatively skillful in sewing operations has been registered as mode "intermediate" in user registration. However, since "50 patterns" set at "number of patterns displayed" for "item no. 2" are not enough, the settings were edited to "100 patterns" applied to "expert" users as shown in FIG. 12 in response to the confirmation message "Do you want to edit?"

Figure 10:
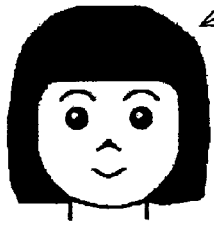
FIG. 10 describes a data configuration of data for user "daughter YL" stored in the user information memory.

Next, a description will be given on the case where the user is "daughter YL". Daughter YL, being a beginner at sewing machine operation will register herself with mode "beginner" after capturing her front face with image sensor 12 without any gesture expressions. Thus, the recognition image data of the front face of user "daughter YL" is stored in user settings memory 19*b* with mapping to mode "beginner", and settings for mode "beginner" read from settings memory 19*a* as shown in FIG. 10.

Figure 11:
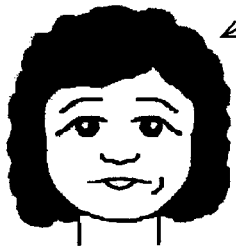
FIG. 11 describes a data configuration of data for user "grandmother GM" stored in the user information memory.

Further, a description will be given on the case where the user is "grandmother GM". The grandmother GM, being highly skillful in sewing machine operation, will register herself with mode "expert" after capturing her front face with image sensor 12 without any gesture expressions. Thus, the recognition image data of the front face of user "grandmother GM" is stored in user settings memory 19*b* with mapping to mode "expert", and settings for mode "expert" read from settings memory 19*a* as shown in FIG. 11.

Figure 13:
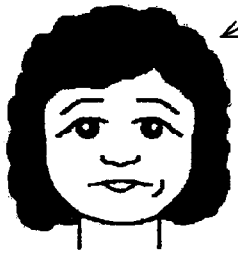
FIG. 13 corresponds to FIG. 11 after user editing of settings.

Grandmother GM being highly skillful in sewing operations has been registered as mode "expert" in user registration. However, since "small" set at "character size displayed" provides poor visibility, the settings have been edited to "large" and "brightness" has been changed to "bright" to provide good visibility of LCD 10 as shown in FIG. 13.

Next, a user-by-user description will be given on registration of operation instructions. Since the method of registration of operation instructions are the same regardless of whether the user is "mother YM", "daughter YL", or "grandmother GM", a description will be given through the example of "mother YL" to cover other user scenarios.

In response to the message "open your mouth" instructed by "item no. 1", user "mother YM" facing image sensor 12 to shoot her face, will press the shoot key after posing a gesture expression with her mouth wide open. Thus, a recognition image data of the gesture expression of mother YM's mouth open is stored in gesture expression memory 19*c* with mapping to the corresponding operation instruction "stop sewing" as shown in FIG. 14.

Figure 15:
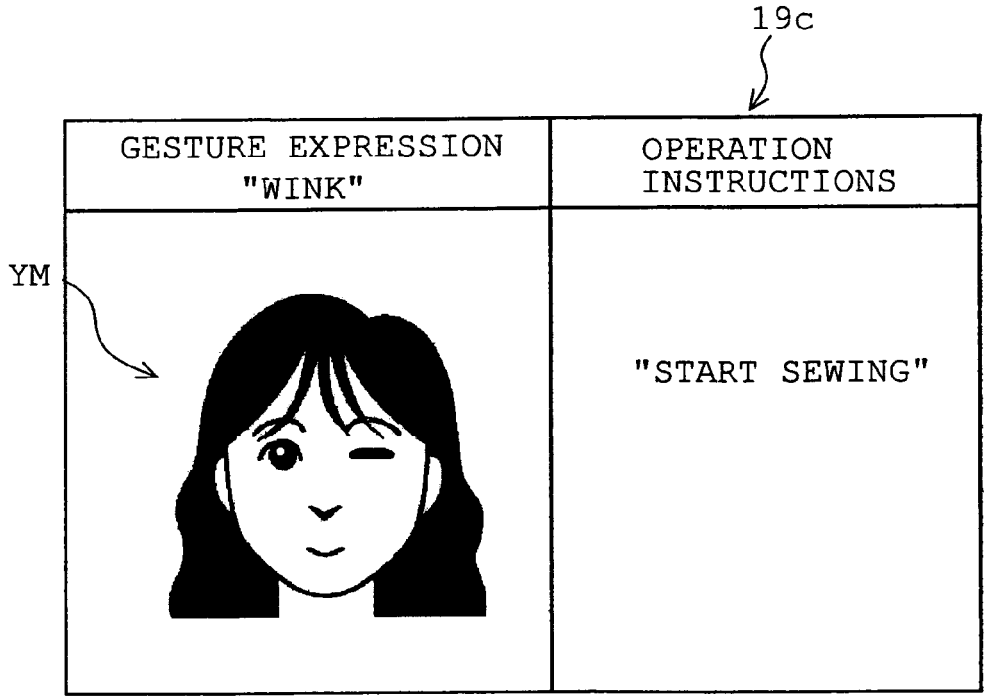
FIG. 15 is a portion of FIG. 5 describing a data configuration of "mother YM" for gesture expression "wink"

Then, in response to the message "wink" instructed by "item no. 2", user "mother YM" facing image sensor 12 to shoot her face, will press the shoot key after posing a gesture expression of a wink, in which mother YM closes her "left eye", for example. Thus, recognition image data of the gesture expression of mother YM winking (left eye) is stored in gesture expression memory 19*c* with mapping to the corresponding operation instruction "start sewing" as shown in FIG. 15.

Similarly, in response to the instructions of gesture expressions such as "stick out your tongue", "move your face closer", and "move your face farther away" instructed by "item no. 3" to "item no. 9", the user "mother YM" facing image sensor 12 for capturing the images of her face, will capture the gesture expressions sequentially to additionally store the recognition image data of these gesture expressions with mapping to the corresponding operation instructions given in "item no. 3" to "item no. 9", respectively.

Figure 16:
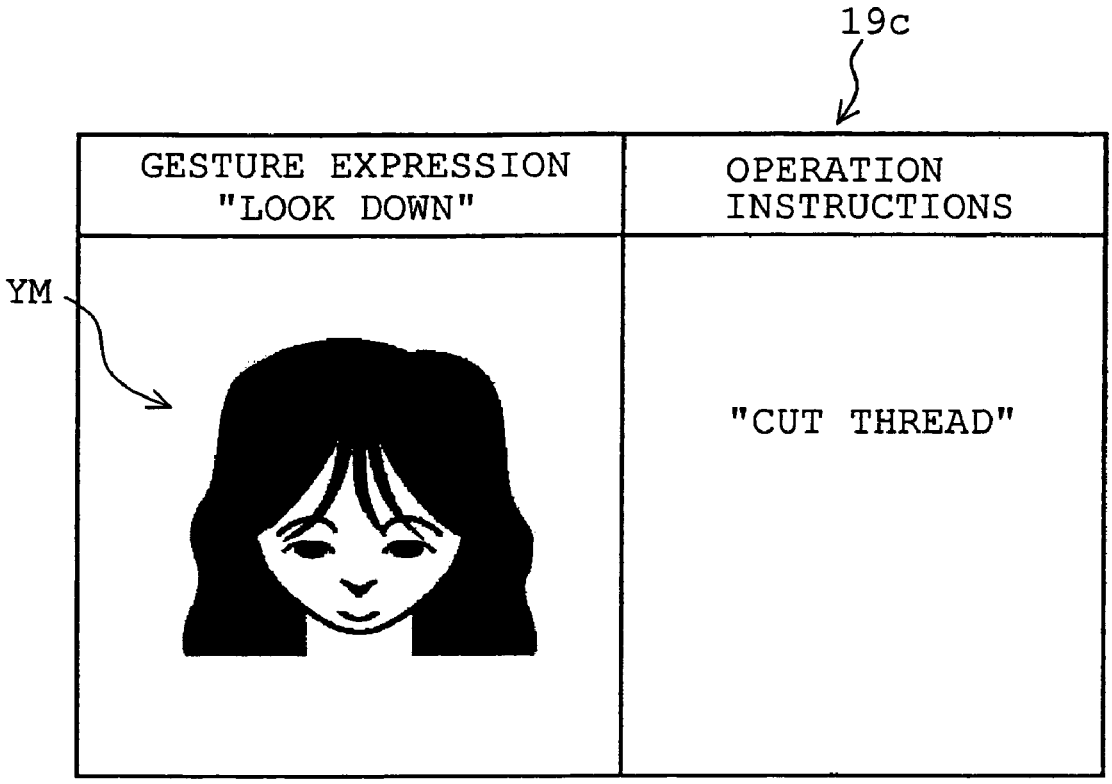
FIG. 16 is a portion of FIG. 5 describing a data configuration of "mother YM" for gesture expression "look down".

Finally, in response to the message "look down" instructed by "item no. 10", user "mother YM" facing image sensor 12 to capture her face, will press the shoot key after posing a gesture expression with her face looking down. Thus, recognition image data of the gesture expression of mother YM looking down is stored in gesture expression memory 19*c* with mapping to the corresponding operation instruction "cut thread" as shown in FIG. 16.

Next, when sewing preparation has been completed by placing the workpiece cloth to be sewn on bed 1, either "mother YM", "daughter YL", or "grandmother GM", whoever is using sewing machine M, will initially capture her front face by image sensor 12. If the user is "mother YM", since her front face has already been captured and registered to user settings memory 19*b*, all the settings pertaining to the mode stored in user settings memory 19*b* with mapping to the facial recognition image data of the of mother YM is read and the sewing machine components are controlled based on each item of the settings.

More specifically, in case "mother YM" is the user, the sewing machine is controlled in accordance with the pre-stored settings for "item no. 1" to "item no. 20" shown in FIG. 12. Accordingly, "sewing speed" is controlled at "800 rpm", maximum "number of patterns displayed" at "100 patterns", "character size" at "normal", "terminology" at "plain", "speed at sewing start" at "normal start", "error sound" at "warning only", . . . , and "brightness" at "normal".

Then, when sewing preparation has been completed, "mother YM" takes a posture that allows her face to be captured by image sensor 12 and operates the operation instruction key. Thereafter, when mother YM makes a gesture expression (refer to FIG. 15) of "wink (left eye)", the operation instruction of "start sewing" is outputted to drive sewing machine motor 24 and start the sewing operation at normal speed.

Thereafter, when mother YM "sticks out her tongue" upon completion of sewing operation, the operation instruction of "form reverse stitch" is outputted, based upon which the reverse stitches are formed. Then, in response to the gesture expression of "open (your) mouth" (refer to FIG. 14), the drive of sewing machine motor 24 is stopped, whereby the sewing operation is stopped. Subsequently, in response to the gesture expression of "look down" of mother YM (refer to FIG. 16), thread cut motor 27 is driven to cut the thread, whereby the needle thread and the bobbin thread are cut to complete the sewing operation.

Next, a description will be given on the case where daughter YL is the user of sewing machine M. When sewing preparation has been completed by placing the workpiece cloth to be sewn on bed 1, daughter YL will capture her front face by image sensor 12. Since the front face of daughter YL has also been captured and registered to user settings memory 19*b*, all the settings pertaining to the mode stored in user settings memory 19*b* with mapping to the recognition image data of the face of daughter YL is read and the sewing machine components are controlled based on each item of the settings.

More specifically, in case "daughter YL" is the user, the sewing machine is controlled in accordance with the pre-stored settings for "item no. 1" to "item no. 20" shown in FIG. 10. Accordingly, "sewing speed" is controlled at "600 rpm", maximum "number of patterns displayed" at "30 patterns", "character size" at "large", "terminology" at "easy", "speed at sewing start" at "low-speed start", "error sound" at "all", . . . , and "brightness" at "bright".

Then, when sewing preparation has been completed, "daughter YL" takes a posture to allowing her face to be captured by image sensor 12 and operates the operation instruction key. The resulting operation after the operation instruction hereinafter is the same as described for mother YM, hence the details for daughter YL will not be given.

Next, a description will be given on the case where grandmother GM is the user of sewing machine M. When sewing preparation has been completed by placing the workpiece cloth to be sewn on bed 1, grandmother GM will capture her front face by image sensor 12. Since front face of grandmother GM has also been captured and registered to user settings memory 19*b*, all the settings pertaining to the mode stored in user settings memory 19*b* with mapping to the facial recognition image data of grandmother GM is read and the sewing machine components are controlled based on each item of the settings.

More specifically, in case "grandmother GM" is the user, the sewing machine is controlled in accordance with the pre-stored settings for "item no. 1" to "item no. 20" as shown in FIG. 13. Accordingly, "sewing speed" is controlled at "1000 rpm", maximum "number of patterns displayed" at "100 patterns", "character size" at "large", "terminology" at "expert", "speed at sewing start" at "high-speed start", "error sound" at "none", . . . , and "brightness" at "bright".

Then, when sewing preparation has been completed, "grandmother GM" takes a posture to allow her face to be captured by image sensor 12 and operates the operation instruction key. The resulting operation after the operation instruction hereinafter is the same as described for mother YM, hence the details for grandmother GM will not be given.

As described above, the recognition image data is generated by capturing the front face of the user by image sensor 12 provided on arm 3 and stored in user settings memory 19*b* with a mapping to the settings of the registered mode. Thus, a plurality of components of sewing machine M can be controlled based on settings preset depending on the technical maturity of the user by merely verifying the identity of the user at the start of sewing operation.

Further, variations of facial gesture expressions of the user are captured by image sensor 12 and operation instructions directed to sewing machine M are assigned to each of the gesture expressions. The plurality of recognition image data of the gesture expressions thus associated with the operation instructions are stored in gesture expression memory 19*c* with mapping to the corresponding operation instructions. The recognition image data of the user gesture expressions captured by image sensor 12 during the sewing operation is searched for a match in gesture expression memory 19*c*. If a matching gesture expression is found, the operation instruction corresponding to the gesture expression is outputted. Thus, even if the user's hands are occupied during the sewing operation, various sewing control can be executed as required on sewing machine M by execution of the gesture expressions captured prior to the start of sewing operation.

Yet, further, the mode settings for each user specified in user settings memory 19*b* can be edited item-by-item to optimize the control of sewing machine M function based on user technical maturity. Thus, the settings for a given item in the mode settings may be edited as required according to the user's personal preference.

Furthermore, the medium for storing the control programs for user registration and execution of operation instructions, and other controls is not limited to ROM 17, but may be retrievably stored in medium such as flexible disk, CD-ROM, DVD-ROM, memory card, and other types of nonvolatile memory.

The present disclosure is not limited to the above described exemplary embodiment but may be modified or expanded as follows.

Gesture expression memory 19*c* that stores recognition image data of each gesture expressions with mapping to the operation instructions may further store mapping to audio information of the operation instructions. In such case, when a registered gesture expression that matches the user gesture expression is found during the sewing operation, the user is allowed to confirm execution of the corresponding operation instruction by audio information as well.

Image sensor 12 provided on arm 3 may be implemented by a CMOS (Complementary Metal Oxide Semiconductor) type available at lower cost or other types of imaging devices instead of a CCD. Further, image sensor 12 may be a monochrome sensor or a color sensor.

Image sensor 12 may be provided at the upper front face of head 4 or at the upper portion of LCD 10.

The mode is not limited to the three modes, namely "beginner", "intermediate", and "expert" but may be classified into greater number of modes such as "level 1", "level 2", "level 3", "level 4", "level 5", . . . , and "level n".

In the present exemplary embodiment, item no. 4 "terminology" in the settings indicates the level of technical terms used in the displayed messages depending on user technical maturity. However, item no. 4 may also reflect the level of vocabulary, grammar and character systems used in the messages depending on user literacy in the local language where the sewing machine is being used. A Japanese user, for example, may find such provision useful since the Japanese writing system has three different character systems namely, hiragana, katakana, and kanji, and kanji characters, used in combination with the two other characters systems, is generally used more frequently as the level of literacy increases.

The items of the settings stored in settings memory 19*a* described in the above described exemplary embodiments are merely examples. The settings may include items for controlling any of the components provided in sewing machine M such as turning ON/OFF a lamp that illuminates a needle plate from above and enabling/disabling an audio guide function if such function is available.

The present exemplary embodiment takes a face shot of the user by image sensor 12 provided on arm 3 of sewing machine M. However, sewing machine M may be arranged to retrieve a face shot of the user taken by an external source such as a digital camera.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a sewing controller that controls a plurality of sewing machine components;

an imaging element capable of capturing facial images of a sewing machine user;

a settings storage that stores settings for a plurality of preset modes, the settings comprising a plurality of items pertaining to a plurality of sewing machine functions;

a user information storage that stores facial image data of the user captured by the imaging element with mapping to the settings of the mode registered with the user;

a verifier that verifies whether or not image data that matches the facial image data captured by the imaging element at sewing operation start exists in the user information storage; and an instruction controller that reads the settings from the user information storage when receiving a positive verification result from the verifier, and that instructs the sewing controller to control the sewing machine components based on the settings read.

2. The sewing machine of claim 1, further comprising an operation instruction assignor that assigns a plurality of operation instructions directed to the sewing machine to a plurality variations of facial gesture expressions of the user captured by the imaging element, and a gesture expression storage that stores gesture expression image data with mapping to the operation instructions assigned by the operation instruction assignor, wherein, the instruction controller searches the gesture expression storage for image data that matches the gesture expression image data of the user captured by the imaging element during the sewing operation, and that outputs the operation instruction mapped with the gesture expression image data to the sewing controller when the matching gesture expression image data is found.

3. The sewing machine of claim 1, further comprising an editor that allows editing of each item in the mode settings registered with each user in the user information storage to customize the settings according to user technical maturity.

4. The sewing machine of claim 1, wherein the imaging element comprises a CCD (Charge Coupled Device) image sensor or a CMOS (Complimentary Metal Oxide Semiconductor) image sensor.

5. A computer readable medium storing a control program for use in a sewing machine including a sewing controller that controls a plurality of sewing machine components, an imaging element capable of capturing facial images of a sewing machine user, and data storage that stores settings for a plurality of preset modes, the settings comprising a plurality of items pertaining to a plurality of sewing machine functions, the control program, comprising:

an instruction for storing facial image data of the user captured by the imaging element in the data storage with mapping to the settings of the mode registered with the user;

an instruction for verifying whether or not image data that matches the facial image data captured by the imaging element at sewing operation start exists in the data storage; and an instruction for instructing the sewing controller to control the sewing machine components based on the settings read from the data storage when receiving a positive verification result.

6. The control program stored in the medium of claim 5, further comprising an instruction for assigning a plurality of operation instructions directed to the sewing machine to a plurality variations of facial gesture expressions of the user captured by the imaging element, and an instruction for storing gesture expression image data with mapping to the assigned operation instructions, wherein the data storage is searched to find image data that matches the gesture expression image data of the user captured by the imaging element during the sewing operation, and the operation instruction mapped with the gesture expression image data is outputted to the sewing controller when the matching gesture expression image data is found.

7. The control program stored in the medium of claim 5, further comprising an instruction for editing each item in the mode settings registered with each user in the data storage to customize the settings according to user technical maturity.

* * * * *